US005876500A

United States Patent [19]

Kurimoto

[11] Patent Number: 5,876,500

[45] Date of Patent: Mar. 2, 1999

[54] COATING APPARATUS

[75] Inventor: Yasuo Kurimoto, Otsu, Japan

[73] Assignee: Toray Engineering Co., Ltd, Osaka, Japan

[21] Appl. No.: 44,037

[22] Filed: Mar. 19, 1998

Related U.S. Application Data

[62] Division of Ser. No. 675,927, Jul. 5, 1996, Pat. No. 5,766, 356.

[30] Foreign Application Priority Data

| | | | |
|---|---|---|---|
| Jul. 6, 1995 | [JP] | Japan | 7-196215 |
| Jul. 6, 1995 | [JP] | Japan | 7-196216 |
| Feb. 6, 1996 | [JP] | Japan | 8-45499 |

[51] Int. Cl.[6] ..... B05C 11/00

[52] U.S. Cl. ..... 118/669; 118/712; 118/410; 427/210

[58] Field of Search ..... 427/210, 209, 427/8, 256; 118/410, 669, 712, 679, 419

[56] References Cited

U.S. PATENT DOCUMENTS

| | | |
|---|---|---|
| 2,263,861 | 11/1941 | Stolper et al. . |
| 2,761,418 | 9/1956 | Russell . |
| 4,250,211 | 2/1981 | Damrau et al. . |
| 4,675,230 | 6/1987 | Innes . |
| 4,905,913 | 3/1990 | Frikker . |
| 5,136,972 | 8/1992 | Naka et al. . |
| 5,282,575 | 2/1994 | Krulick et al. . |

FOREIGN PATENT DOCUMENTS

| | | |
|---|---|---|
| 7-80386 | 3/1995 | Japan . |

*Primary Examiner*—Brenda A. Lamb
*Attorney, Agent, or Firm*—Burns, Doane, Swecker & Mathis, L.L.P.

[57] ABSTRACT

A coating apparatus including a slit die 4 for applying a liquid to a surface of a resin film. The slit die 4 ha a die body which is rotatable between an operating position whereat an injection nozzle 13*a* of the slit die 13 faces a back-up roller 2 for feeding the resin film 50 and a rest position where the nozzle 13*a* is spaced from the resin film or foil 50. A cleaning device is provided having a roll 40 of a cleaning sheet 41, a take-up roller 23 for taking up the cleaning sheet, and a cleaning roller 24, on which the cleaning sheet moves. The cleaning sheet 41 on the cleaning roller 24 faces the injection nozzle 13*a* of the slit die when the latter is in its rest position for executing a cleaning operation. After an application of the liquid to a front surface of the resin film, the liquid is also applied to a rear surface of the film, so that the applied layers 50*a* on the front surface are registered with the applied layers 50*b* on the rear surface. Sensors 38 and 39 are provided for detecting ends of the layers 50*a* and 50*b*, so that a positional deviation, measured between the layers 50*a* and 50*b*, is used for correction of the timing of an application and interruption of the feed of the liquid to the rear surface, thereby maintaining a registration of the applied layers 60*a* and 60*b* between the front and rear surfaces of the resin film.

2 Claims, 6 Drawing Sheets

COATING APPARATUS

This application is a divisional, of application Ser. No. 08/675,927, filed Jul. 5, 1996, now U.S. Pat. No. 5,766,356.

BACKGROUND OF THE INVENTION

1. Field of the Invention

The present invention relates to a coating apparatus for applying at a predetermined spacing to a surface of an object a liquid such as a synthetic resin or a paint. The present invention relates also to a coating apparatus wherein it has a slit shaped die which is subjected to cleaning each time when the coating operation is interrupted. Furthermore, the present invention relates to a coating device for applying, to an article having a first surface already applied with a liquid, a liquid at the opposite second surface at locations which are aligned with the locations where the liquid is applied at the first surface. The present invention can be suitable for applying a liquid synthetic resin to an aluminum or copper foil which is used for producing a re-chargeable battery such as a lithium ion type.

2. Description of Related Art

Known in a prior art is a coating apparatus for applying, at a predetermined spacing, a liquid such as a liquid synthetic or a paint on an object to be applied, such an endless sheet of a synthetic resin or paper or foil, or lengths of sheets of glass or wafer, which device is provided with a conveyor for obtaining a horizontal movement of the object to be applied with the liquid and a slit die located above the conveyor and formed with a liquid injection nozzle. The coating device is further provided with a drive mechanism such as a fluid cylinder for generating a movement of the slit die vertically or horizontally with respect to an object on the conveyor in such a manner that the liquid injection nozzle is moved between a liquid applying position (operating position) and a rest position.

This type of the coating device is defective in that, during an application process of the liquid, some of the applied liquid, in the shape of droplets, is likely to be attached to a tip end of the liquid injection nozzle. The droplets are, together with the liquid from the nozzle, applied to the surface of the object, which makes it difficult to obtain an uniformly applied layer of the liquid.

To overcome this difficulty, Japanese Unexamined Patent Publication 7-80386 discloses a cleaner for removing the droplets of the liquid attached to a tip end of the liquid infection nozzle. Namely, this cleaner is provided with a cleaning mechanism arranged at an end of the conveyor. When a cleaning of the liquid injector is necessary, the slit die is, first, raised from the operating position, by a predetermined amount, to a rest position and is, then, moved horizontally toward the cleaner.

The above-mentioned construction for making the slit die to be moved vertically or horizontally is disadvantageous in that the movement of the slit die must be slow in order to prevent a large impact force from being generated when the slit die is stopped.

Furthermore, in the prior art wherein the vertical and horizontal movements of the slit die are repeated, the impact forces as generated upon the stoppage causes variations to be generated in a vertical spacing between the liquid injecting position of the slit die for executing the application operation as well as in a horizontal position of the slit die with respect to the object, thereby generating unevenness in the thickness of the applied layer of the liquid as well as a deviation of the liquid applying position from the desired position.

Furthermore, the prior art is also disadvantageous in that the cleaning operation of the liquid nozzle of the slit die requires a mechanism which allows the slit die to be moved in both the vertical and horizontal directions, which makes the mechanism to be complicated, on one hand, and, on the other hand, makes the stoppage time, for executing the cleaning operation, long and which reduces the production efficiency.

The coating apparatus is used also for applying liquid on both surfaces of a resin film. In this case, an application of liquid is, first, done on the first surface (front surface) of the film, so that spaced applied layers are formed on the first surface. Then, an application of the liquid is done on the opposite surface (rear surface). The timing of the application of the liquid to the rear surface is controlled so that the applied layers of the liquid on the rear surface are in a registered condition with the opposite layers of liquid is on the front surface. In order to do this, a sensor is provided at a location upstream from the slit die for detecting a position of a length of applied liquid on the front surface of the film. A calculation of the timing for starting and stopping of the application of the liquid (for rotating the liquid feed pump) is done based on the rotating speed of an electric motor for feeding the film, i.e., the speed of the movement of the film. The operation of the feed pump at the calculated timings cause a length of the liquid to be formed on the rear surface of the film.

This register control is however defective in that a slippage of the film fed by a roller mechanism as well as an elongation of the film, which are inevitable, cause errors to be generated in the positions for the commencement and or the interruption of the application of the liquid and, thereby, liquid layers to be misregistered between the front and rear surfaces, which causes the product quality to drop.

SUMMARY OF THE INVENTION

An object of the present invention is to provide a coating apparatus capable of providing high precision in the movement of a slit die between a fluid applying position and a rest position.

Another object of the present invention is provide a coating apparatus capable of preventing a spacing, between the slit die in its liquid injecting position and the object to be applied by the fluid from varying.

Still another object of the present invention is to provide a coating apparatus capable of providing a positive cleaning operation each time a liquid applying operation is stopped.

Further object of the present invention is to provide a coating apparatus capable of obtaining an automated error correction in the positions of application of the liquid between the front and rear surfaces of the film, thereby obtaining a registered condition of the applied positions between the front and rear surfaces of the film.

According to a first aspect of the present invention, an apparatus is provided for applying a liquid to an object, comprising:

a frame;

a slit die having a nozzle for injecting the liquid, said slit die having ends spaced in a direction of a width of said object and rotatably connected to the frame, and;

drive means for obtaining a rotating movement of the slit die between an operating position where the nozzle is faced with the object for allowing that the liquid from the nozzle to be applied to said object and a rest position where the nozzle is spaced away from the object for interrupting the liquid from being applied to the object.

Such an arrangement is advantageous in keeping a reduced inertia of the slit die during its rotating movement, thereby reducing an impact when it is stopped, which assists in speeding up the movement of the slit die between the operating and rest positions. Furthermore, a reduction becomes possible as to the spacing between the slit die in its operating position and the object applied by the liquid.

According to a second aspect of the present invention, an apparatus is provided for applying a liquid to an object, comprising:

a frame;

a slit die having a nozzle for injecting the liquid, said slit die having ends spaced in a direction of a width of said object and rotatably connected to the frame;

drive means for obtaining a rotating movement of the slit die between an operating position where the nozzle is faced with the object for allowing the liquid from the nozzle to be applied to said object and a rest position where the nozzle is spaced away from the object for stopping the liquid being applied to the object, and;

a cleaning means for cleaning the nozzle when the slit die is in its rest position.

This arrangement is advantageous in that clearing is done every timing that the slit die is rotated to the rest position, thereby maintaining a cleaned state of the slit die.

According to a third aspect of the present invention, an apparatus is provided for applying, to an object having a first surface on which layers of applied liquid are formed at a predetermined spacing along a length of the object, the liquid at the opposite, second surface, said apparatus comprising:

conveyor means for moving said object along a direction of its length;

a slit die having a nozzle arranged to be faced with the second surface of the object;

sensor means arrange at a location upstream from the slit die in the direction of the feed of the object for detecting a layer of applied liquid on the first surface of the object;

means responsive to the detection by the sensor means, for executing the liquid applying operation to the second surface of the object by means of said slit die;

additional sensor means arranged at a location downstream from the slit die for detection a positional relationship of the applied layers between the first and second surfaces of the object, and;

means, responsive to the relationship detected by said downstream sensor, for correcting the liquid applying operation for applying the liquid to the second surface of the object when a new applied layer is detected by the upstream sensor in such a manner that a predetermined positional relationship of the applied layers is obtained between the first and second surfaces.

This construction is effective for automatic is correction of the applied position of the liquid on the second surface of the object, thereby obtaining the object such as a resin film having applied layers with a desired registration between the front and rear surfaces, thereby enhancing the production yield.

BRIEF EXPLANATION OF ATTACHED DRAWINGS

DESCRIPTION OF PREFERRED EMBODIMENTS

Figure 1:
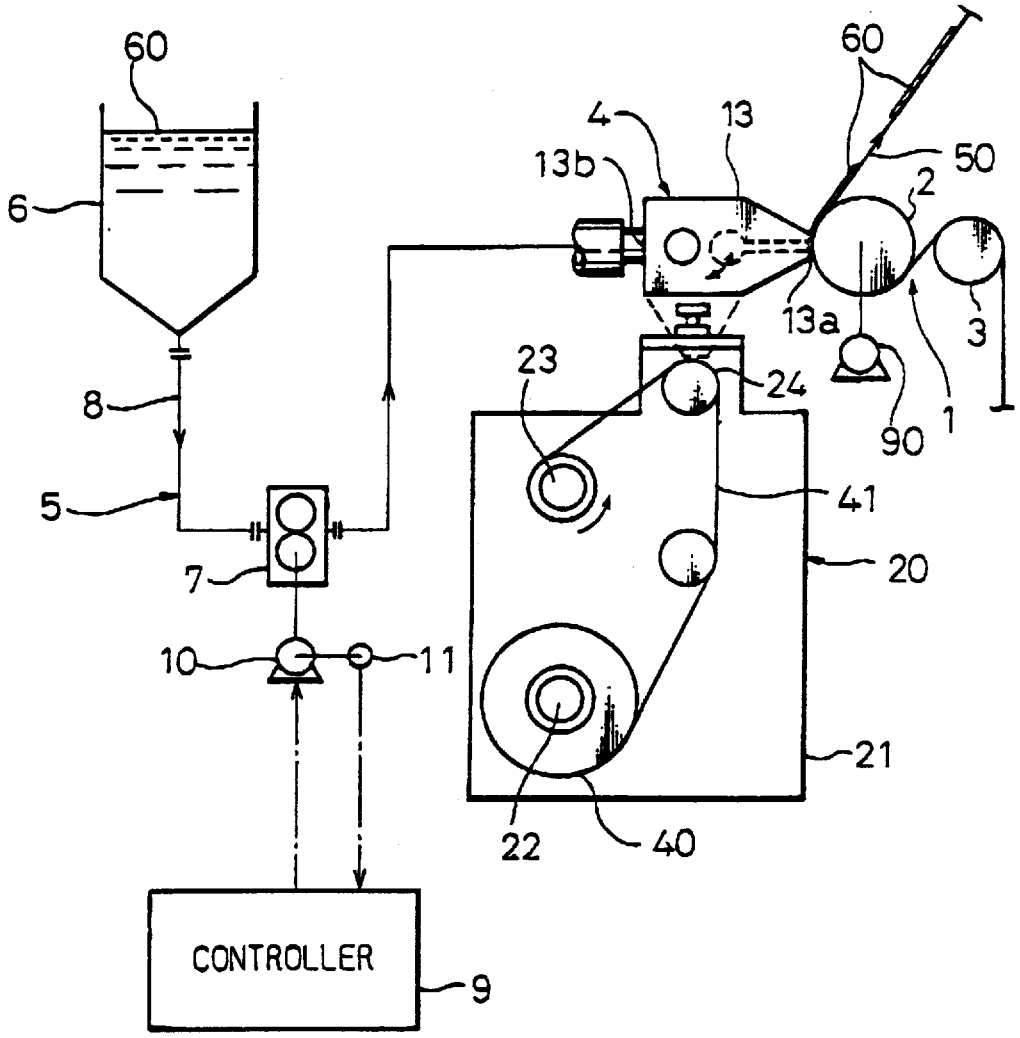
FIG. 1 is a schematic view of a coating apparatus according to the first embodiment of the present invention.

FIG. 1 shows schematically a coating apparatus according to a first embodiment of the present invention. The coating apparatus includes: a conveyor mechanism 1 having a drive motor 90, a back-up roller 2 for moving a film 50 such a metal (aluminum or copper) film or a resin material to which a liquid such as a carbon (filler)-incorporated synthetic resin is to be applied and a guiding roller 3 for guiding the film 50 to be moved to the back-up roller 2; a slit die 4 which is arranged to face with the back-up roller 2 via the film 50, so that the liquid is injected to the film 50 at a location where the latter is contacted with the back-up roller 2; a liquid tank 6 for the liquid 60 which is in connection with the slit die 4, so that the liquid to be applied is supplied to the slit die 4; a liquid feeding device 5 having a constant amount pump 7 formed as, for example, a gear pump and a liquid feeding conduit 8 for connecting the liquid tank 6 with the slit die 4; a controller 9 formed, for example, as a microcomputer unit for generating electric signals for operating the pump 7, which controller 9 has an input device such as a keyboard (not shown) and output devices such as a monitor and can attain, based on stored programs, various functions such as a data input function, a comparing function, an arithmetic calculating function, and a command function, and; a cleaner 20 arranged below the slit die 4. In place of arranging the slit die 4 so as to be faced with the back-up roller 2 as illustrated in FIG. 1, the slit die 4 can be located at a position between a pair of guide rollers for guiding a film and spaced at a predetermined distance in such a manner that the slit die 4 is faced with the film moving between the guide rollers.

Figure 2:
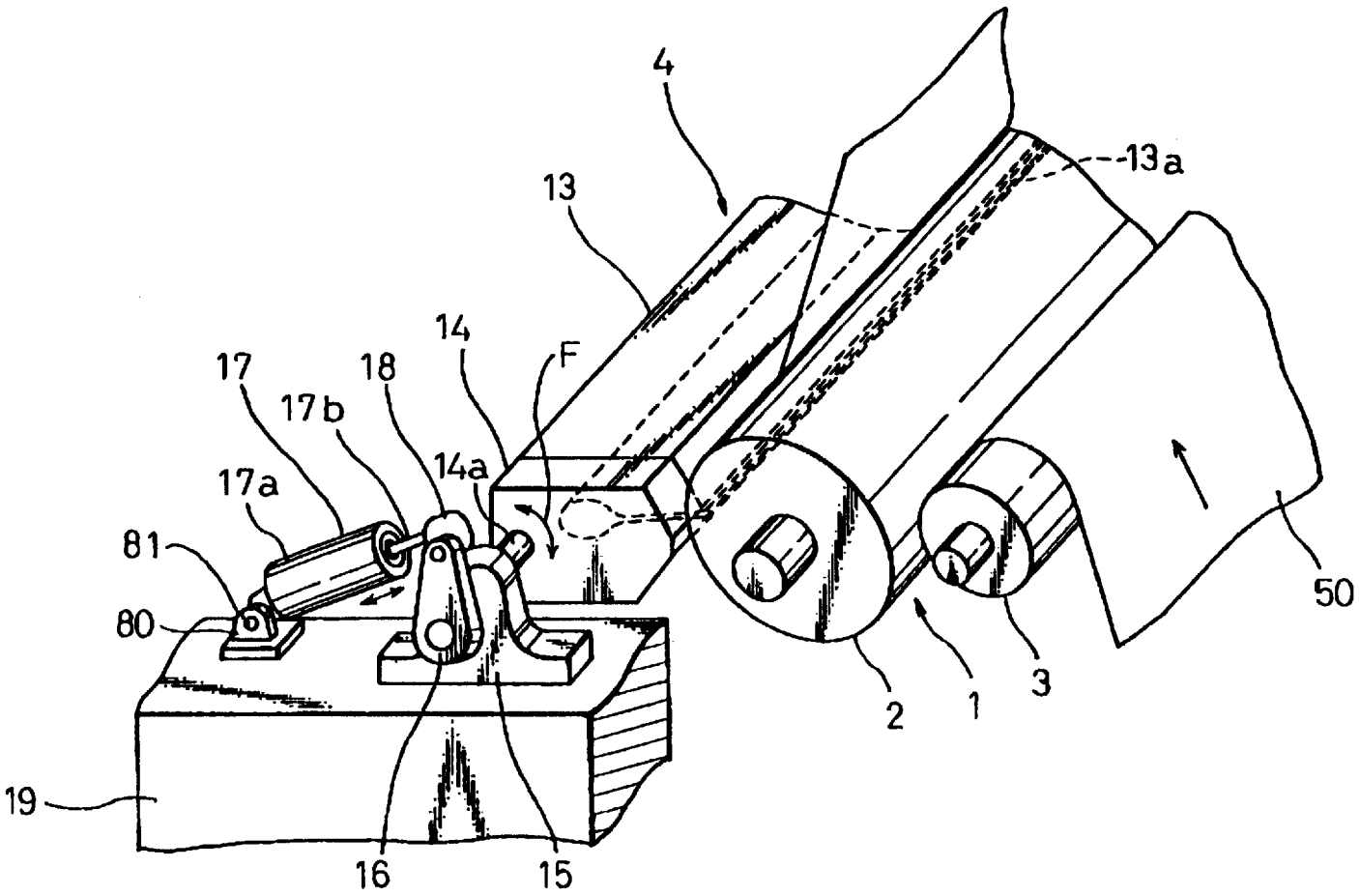
FIG. 2 is a perspective view of a slit die in FIG. 1.

In FIG. 2, the slit die 4 is provided with: a die body 13 extending parallel to the axis of the back-up roller 2 and formed with an inlet (not shown in FIG. 2) connected to the feed pipe 8 in FIG. 1 for receiving the liquid from the pump 7 and a slit shaped injecting nozzle 13*a* extending along the axis of the roller 2 and faced with an outer cylindrical surface of the roller 2; side plates 14, only one of which is shown in FIG. 2, fixedly attached to the die body 13 and having stub shafts 14*a* fixedly connected to the respective side plates 14; a pair of bearing units 15 on a machine frame 19 for rotatably supporting the respective stub shafts 14*a* in such a manner that the die body 13 can rotate about the axis of the shafts 14*a* as shown by an arrow F; an arm 16, which is at its bottom end, fixedly connected to the shaft 14*a*; and a fluid cylinder 17 constructed by a cylinder body 17*a* which is rotatably connected to a pair of spaced lugs 80 fixedly connected to a top wall of the machine frame 19 by means of a pin 81 and a piston rod 17*b* which is movable with respect to the cylinder body 17*a*, the piston rod 17*b* having an end connected to a top end of the arm 16 by means of a coupling member 18.

In a well known manner, a piston (not shown) is slidably arranged in the cylinder body 17*a*, so that operating chambers are formed in the body 17*a* on ends of the piston. Connected to the operating chambers are fluid pressure conduits (not shown), on which known elements such as a pressure regulator valve and a directional switch valve are arranged. A control device is also provided for switching the direction of the flow of the fluid pressure between a condition where the fluid pressure causes the piston rod 17*b* to be retracted into the cylinder body 17*a* and a condition where the fluid pressure causes the piston rod 17*b* to be extended out of the cylinder body 17*a*. A movement of the piston rod 17*b* of the cylinder 17 to the retracted position causes the die body 13 to rotated in a counter-clockwise direction in FIG. 2 to an applying position, where the liquid injecting nozzle 13*a* is faced with the outer cylindrical wall of the backup roller 2. Contrary to this, an opposite movement of the piston rod 17*a* of the cylinder 17 to the extended position causes the die body 13 to be rotated in a clockwise direction in FIG. 2 to a rest or waiting position, where the liquid injecting nozzle 13*a* is spaced from the backup roller 2.

In place of the fluid cylinder 17 as means for obtaining a rotating movement of the die body 13, a mechanism constructed as a combination of an electric motor and gear wheels or a mechanism as a combination of an electric motor and screw members can be employed.

In FIG. 1, the electric motor 10 of the liquid feed pump 7 located on the conduit 8 connecting the liquid inlet (not shown) of the die body 13 with the tank 6 is operated by a control signal from the controller 9. The rotating operation of the electric motor 10 of the liquid feed pump 7 is timed with the swing movement of the die body 13 as shown by the arrow F in such a manner that, after the die body 13 is moved to the liquid applying position where the liquid injecting nozzle 13*a* is faced with the back-up roller 2 as shown in FIG. 2, the rotating movement of the electric motor 10 is commenced for allowing the pump 7 to feed the liquid to the nozzle 13*a* and that, after the stoppage of supply of the liquid by the stoppage of the rotating movement of the electric motor 10, the rotating movement of die body 13 to the rest position is commenced.

The cleaner 20 includes a frame 21, a feeding shaft 22 on which a roll 40 of a cleaning sheet 41 is mounted, a taking-up shaft 22 for taking up the cleaning sheet 41 reeled out from the roll 40, and a cleaning roller 24 on which the cleaning sheet 41 is moved and is located below the slit die 4.

Preferably, the frame 21 of the cleaner 20 is made integral with respect to the frame 19 (FIG. 2) of the slit die 19.

Preferably, the feeding shaft 22 is provided with a braking device (not shown) for applying to the cleaning sheet 41 a predetermined tension when it its taken out from the reel 40. Furthermore, a driving mechanism (not shown) is connected to the take-up roller 23 for generating a rotating movement for taking up the cleaning film 41, which mechanism includes various members, such as an electric motor for generating a rotating movement, a reduction gear mechanism for reducing the rotating speed of the rotating motor and an one-way clutch for allowing the taking up shaft 23 to be rotated only in one direction.

Figure 3:
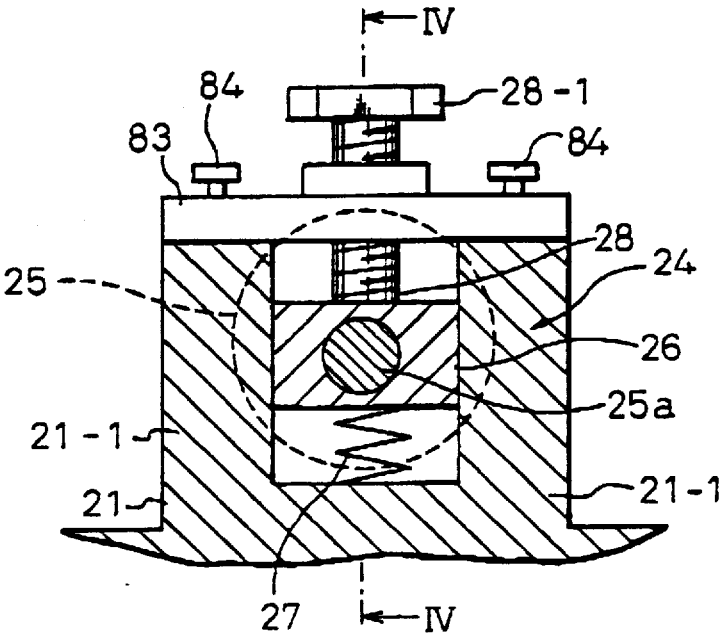
FIG. 3 is a schematic side view of a cleaner roller of the cleaning device in FIG. 1.
Figure 4:
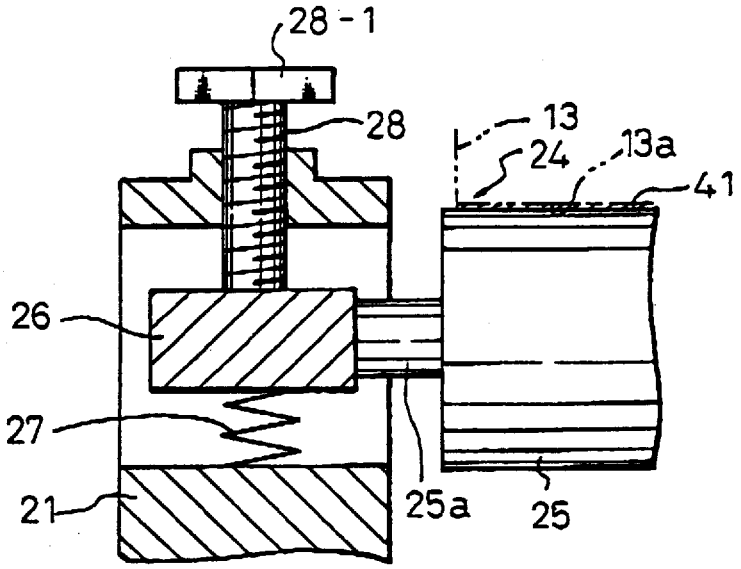
FIG. 4 is a cross sectional view taken along a line IV—IV in FIG. 3.

As shown in FIGS. 3 and 4, the frame 21 of the cleaner 20 includes, at its top portion faced with the slit die 4, axially spaced pairs of spaced slide guide portions 21-1, between which slide bearing members 26 are respectively arranged in such a manner that the slide bearing members 26 are moved vertically along the guide portions 21-1. The cleaner roller assembly 24 is constructed by a roller body 25 around which the cleaner film 41 passes and stub shafts 25*a* at it axial ends, which are rotatably supported by the slide bearings 26, respectively. A spring 27 is arranged between the slide member 26 and the frame 21, while a screw shaft 28 extends integrally, vertically, upwardly from the top surface of the bearing member 26. A nut plate 83 extends horizontally and is connected to the top ends of the paired guide portions 21-1 by means of screws. The nut plate 83 has a screw bore, with which the screw shaft 28 is under a screw engagement. The screw shaft 28 has at its top end a knob portion 28-1 for making the shaft 28 to be easy of the adjustment of the slide bearing member 26. Namely, the cleaning roller 25 is normally under a position which is vertically spaced from the slit die 4. However, when a cleaning operation is to be commenced, the rotating movement is applied to the screw shaft 28 at the knob portion 28-1, which causes the slide member 26 to be vertically moved upwardly, so that the roller body 25 of the cleaning device 24 takes, finally, an operating position, whereat the cleaning sheet wrapped around the roller body 25 is contacted with the tip end of the injection nozzle 13*a* of the die body 13 of the slid die 4 which is under the above mentioned rest position.

It is desirable that the operating position (elevated position) of the cleaner device 24 causes the roller body 25 to be displaced slightly downward against the force of the spring 27, which allows the roller body 25 to be positively contacted with the tip end of the injecting nozzle 13*a* of the die body 13 via the cleaning sheet 41.

In the above arrangement, in place of the spring 27 for allowing the roller body 25 to be displaced downwardly, a fluid cylinder can be employed.

Now, an operation of the coating apparatus with the cleaning device according to the present invention will be explained. During a normal operation for applying the liquid, the back-up roller 2 and the guide roller 3 of the conveyor mechanism 1 are rotated, so that the resin film 50, to which the liquid is applied, is moved at a predetermined speed. A keyboard (not shown) is operated for generating a command, which causes the control device to commence its operation. As a result, switching of the direction of the flow of the pressure fluid to the fluid cylinder 17*a* is done in such a manner that the piston rod 17*b* is retracted, which causes the die body 13 to be moved in the counter clockwise direction as shown by the arrow F in FIG. 2 to the operating position, where the injecting nozzle 13*a* is faced with the back-up cylinder 2 via the film 50. Then, the electric motor 10 is energized, so that the liquid feed pump is brought into an operation, so that the liquid is injected from the nozzle 13*a* to the surface of the film 50 faced with the injection nozzle 13*a*.

When a predetermined length of the liquid as applied is obtained on the film 50, the controller 9 issues a signal for causing the electric motor 10 to be stopped, thereby interrupting the injection of. the liquid from the nozzle 13. Simultaneously, a signal is also issued for causing the direction of the flow of fluid to the fluid cylinder 17*a* to be switched in such a manner that the piston rod 17*b* is extracted, so that the die body 13 is swung in the clockwise direction as shown by the arrow F in FIG. 2 to the rest position. At this rest position of the die body 13, the tip end of the injection nozzle 13*a* is press contacted with the cleaning film 41 wrapped around the roller body 25 of the cleaning unit 24, so that the roller body 25 is slightly moved downwardly against the force of the spring 27, thereby causing the cleaning sheet 41 to wipe or clean the tipe end of the nozzle 13*a*.

When a feed of the resin film 50 applied by the liquid of a predetermined length is done, the controller 9 issues signals, thereby re-commencing the operation of the flow switching valve for the fluid cylinder 17 as well as of the electric motor 10 for the pump. As a result, the piston rod 17*b* of the fluid cylinder 17 is retracted, which allows the die body 13 to be rotated in the counter clockwise direction in FIG. 2, thereby moving the injecting nozzle 13*a* to the operating position where the nozzle 13*a* is faced with the back-up roller 2 via the film 50. Simultaneously, the rotating movement of the electric motor 10 is commenced, which allows the liquid from the tank to be fed to the slit die 4, thereby injecting the liquid to the film. In this operation, the movement of the fluid injection nozzle 13*a* to the operating position allows the take-up roller 23 to take up the cleaning sheet 41, so that the portion of the sheet 41 subjected to the wiping of the nozzle 13*a* is moved away from the nozzle and a new, unused portion of the cleaning sheet 41 faces the slit die 4.

The above mentioned operation is repeated, i.e., the die body 13 is rotated between the operating position for applying the liquid and the rest (wiping) position for wiping the nozzle 13*a*, which is timed with on-off operation of the electric motor 10 for operating the feed pump 7, so that the liquid from the nozzle 13*a* is intermittently applied to a surface of the film 50. In other words, spaced lengths of liquid are applied on a surface of the endless resin film 50. Furthermore, the wiping of the nozzle 13*a* is done each time when the die body 13 is moved to the rest position.

In the description of the above embodiment, the wiping of the nozzle 13*a* by the cleaning sheet 41 during the cleaning operation is done while the latter is stopped. However, as an alternative, the cleaning sheet 41 is moved during the wiping or cleaning operation.

In the above embodiment, the cleaning device 20 is arranged below the slit die 4, while the die body 13 is located downwardly to its rest or wait position. However, as an alternative, the cleaning device 20 is located above the slit die 4, while the die body 13 is rotated upwardly to a its rest or wait position, whereat the injection nozzle 13*a* is contacted with the cleaning device located above the slit die.

In the operation as explained above, the application of the liquid to an endless sheet is explained. However, an intermittent application of the liquid to lengths of sheets, such as glass sheets, wafers is also possible according to the present invention. Namely, in this case, lengths of objects to be applied by the fluid are transported by a conveyor, and a slit die having an injection nozzle is rotated between an operating position and a rest position.

Figure 5:
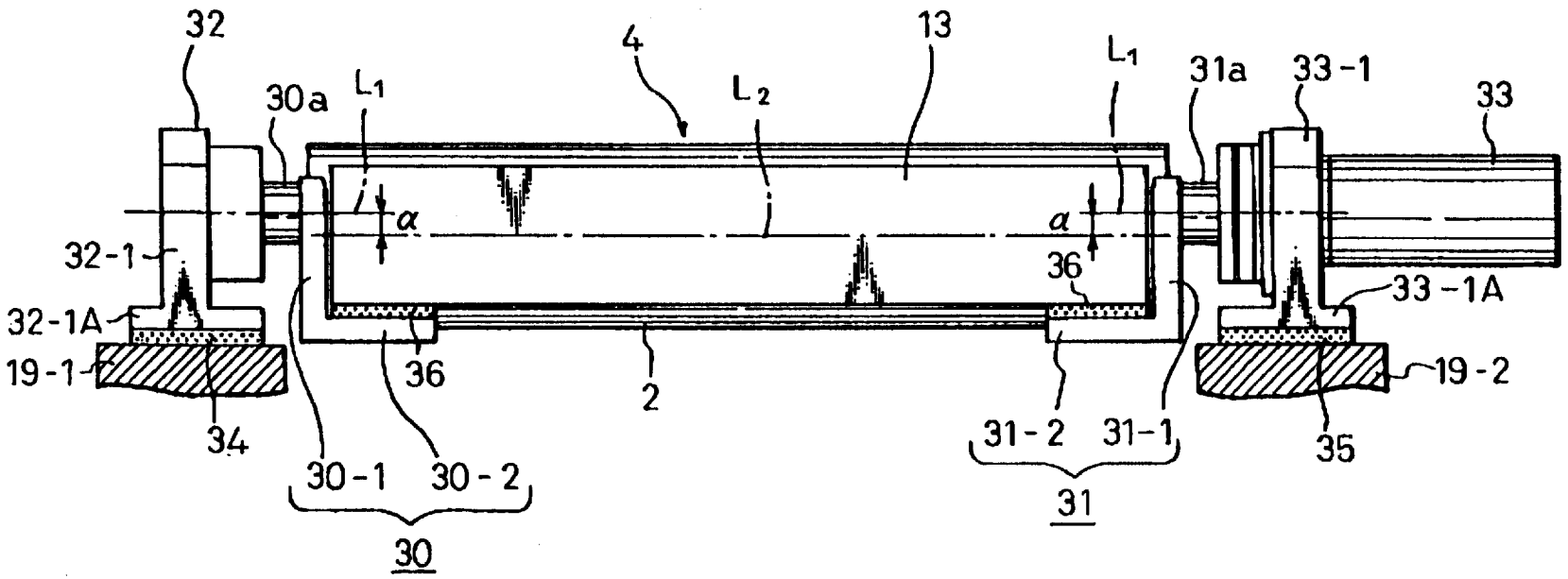
FIG. 5 is a different embodiment directed to a means for obtaining a rotating movement of a die body.
Figure 6:
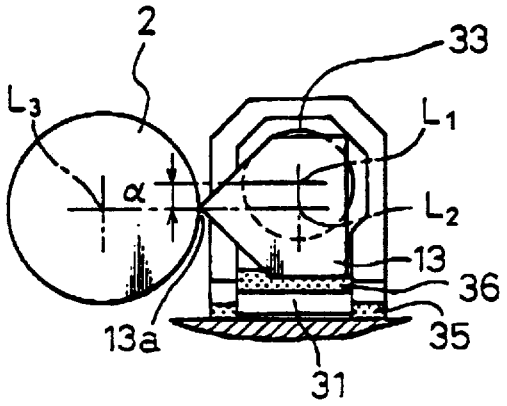
FIG. 6 is a side view of the die body rotating mechanism in FIG. 5.

In place of the mechanism including the fluid cylinder 17 and the arm 16, for obtaining a rotating movement of the die body between the operating position and a rest position in the first embodiment, a rotating motor for generating a direct rotating movement can be employed. Namely, as shown in FIGS. 5 and 6, arms 30 and 31 of L cross sectional shape are connected to opposite axial ends of the die body 13, respectively. The arms 30 and 31 have integral stub shaft portions 30*a* and 31*a*, respectively. The frame 19 is provided with portions 19-1 and 19-2, which are spaced along the axis of the die body 13. A bearing unit 32 is mounted on the frame portion 19-1, while the stub shaft 30*a* is rotatably supported by the bearing unit 32. An AC current servo motor 33 is mounted on the frame portion 19-2, and has a rotating shaft connected to the stub shaft 31*a*.

The AC servo motor 33 has a housing 33-1 having a bottom plate portion 33-1A, which is rested on the motor supporting portion 19-2 of the frame 19 by way of a liner 35. Similarly, the bearing unit 32 has a housing 32-1 having a bottom plate portion 32-1A, which is rested on the supporting portion 19-1 of the frame 19 by way of a liner 34. Furthermore, the arm 30 is constructed by a vertical plate portion 30-1 from which the stub shaft 30*a* extends integrally and a horizontal plate portion 30-1. Similarly, the arm 31 is constructed by a vertical plate portion 31-1 from which the stub shaft 31*a* extends integrally and a horizontal plate portion 31-1. The die body 13 is rested on the horizontal plates portions 30-2 and 31-2 of the L cross shaped arms 30 and 31, respectively, by way of liners 36. The thicknesses of these liners 34, 35 and 36 are adjusted such that a desired value of an offset $\alpha$ is obtained between an axis $L_1$ of the shaft portions 30*a* and 31*a* and an axis $L_2$ of the elongation of the die body 13.

A rotating movement generated by the AC servo motor 33 in one direction causes the die body 13 to be rotated about the axis $L_1$ to a liquid applying position where the injection nozzle 13*a* is faced with the back-up roller 2, thereby allowing application of a liquid on a film moved on the back-up roller 2. At the liquid applying position, the nozzle 13*a* is horizontally aligned with the back up roller 2, i.e., the central axis $L_2$ of the die body 13 and an axis $L_3$ of the back up roller 2 are located on a horizontal plane, on which the nozzle 13*a* is also located.

A rotating movement generated by the AC servo motor 33 in the opposite direction causes the die body 13 to be rotated about the axis $L_1$ to a rest position where the injection nozzle 13*a* is spaced from the back-up roller 2 and faces the cleaner which is not shown in FIGS. 5 and 6 but is of a similar construction to that shown in FIG. 1.

A well-known regenerating circuit is provided in a control circuit for operating the AC servo motor 33, which generates a braking force in the motor 33, which assists the die body 13 to be precisely stopped at the fluid application position as well as at the cleaning position.

In order to obtain a braking operation of the AC servo motor 33, a mechanism such as a speed reduction gear mechanism or an index table may also be provided. In this case, it is desirable that any backlash in the speed reduction mechanism is as small as possible, in order to reduce an error in the position of stoppage of the die body 13.

In place of connecting the shaft portion 31*a* of the arm 31 directly with the rotating shaft of the AC servo motor 33, a coupling unit can be interposed between the shaft 31*a* and the AC servo motor 33. Furthermore, in addition to the AC servo motor 33 for the shaft 31*a* on one end of the die body 13, a further AC servo motor can be provided for the opposite end of the die body 13. This latter variation is desirable when the die body 13 is of a larger length.

In the above construction, an adjustment of the value of the offset $\alpha$ between the axis of rotation of the arms 30 and 31 and the injection nozzle 13*a* allows the rotating angle of the die body 13 to be reduced, while maintaining the desired movement of the die body 13 between the liquid application position as shown in FIG. 6 and the rest position which is rotated from the former position, so that a reduction is obtained in the time for the movement between the two positions. In order to prevent the inertia of the die body 13 from being increased, as when the die body 13 is subjected to the rotating movement between the operating position and the rest position, the value of the offset $\alpha$ is in a range between 1 to 50 mm.

Figure 7:
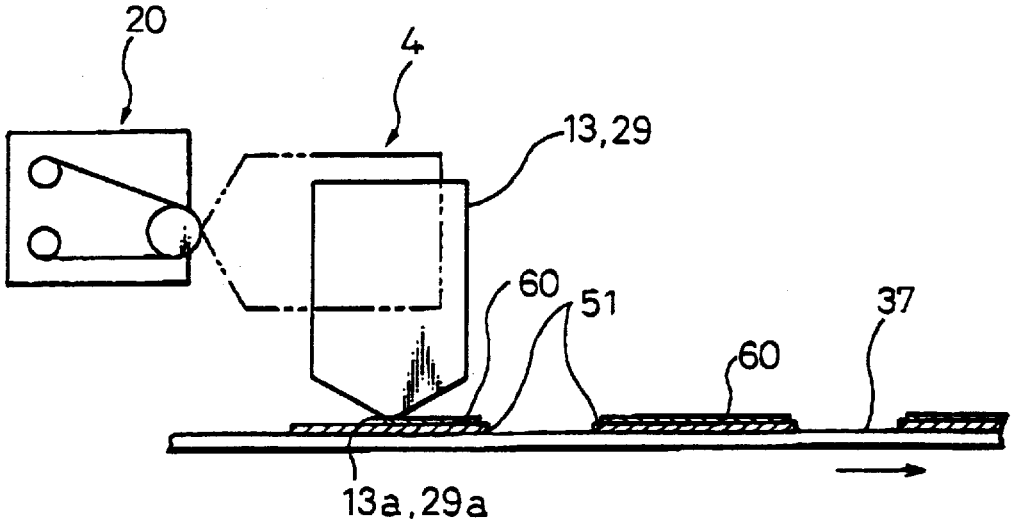
FIG. 7 is a different embodiment directed to a means for moving articles to be fed.

FIG. 7 shows another embodiment, which is suitable for an application of the liquid to lengths of sheet, such as glass plates 51. A conveyor 37, such as a belt type conveyor or an intermittently and reciprocally moved bed is provided for a transportation of the glass plates 51. A slit die 13 is arranged above the conveyor 37 in such a manner that the die body 13 is rotated between a fluid applying position as shown by a solid line where the injection nozzle 13*a* is directed vertically and downward and a cleaning position as shown by a phantom time where the injection nozzle 13*a* is directed horizontally where the latter faces a cleaning device 20.

Figure 8:
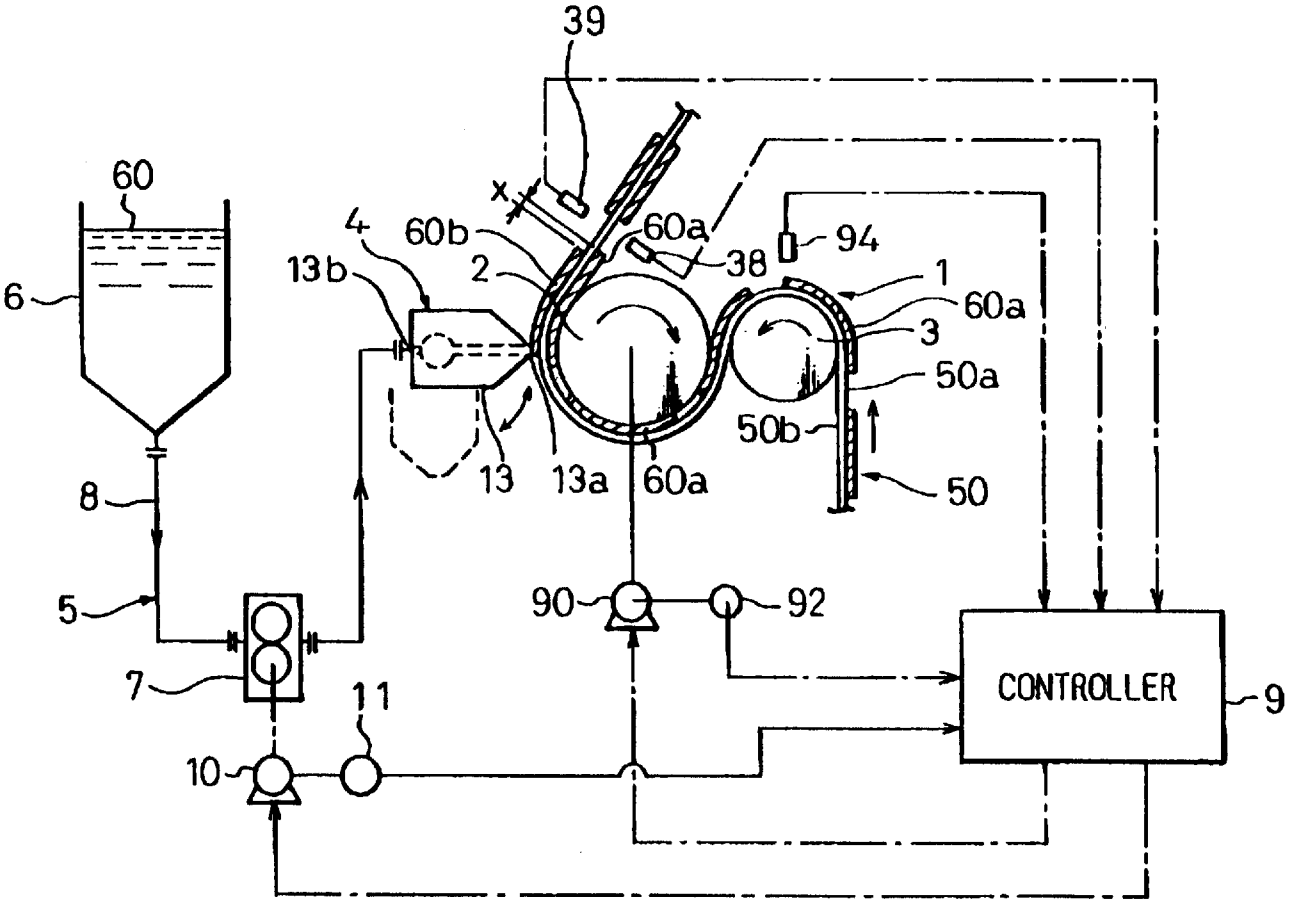
FIG. 8 is a schematic view of a coating apparatus in a different embodiment directed to an application of liquid to a rear surface of a resin film.

Now, a further embodiment of the present invention will be explained with reference to FIG. 8, which is directed to an application, to a film having a surface (a first or a front surface) 50*a* on which the liquid are already applied, of the liquid at the opposite surface (a second or a rear surface) 50*b*, so that a registration of the lengths of the coating is obtained between the front and rear surfaces of the film. In FIG. 8, those parts which are similar to those in FIG. 1 are designated by the same reference numerals and their explanations are omitted. Thus, the construction of the embodiment in FIG. 8 which is different from that in FIG. 1 will now be explained. A sensor 92 is provided for detecting a rotating speed of an electric motor 90 for obtaining a rotating movement of the back-up roller 2, and a signal indicating the rotating speed of the back-up roller 2 is input to the controller 9. An upstream sensor 94 is arranged at a position upstream from the slit die 4 for detecting a leading or trailing end of a length of layer 60*a* of the liquid applied at the front surface 50*a* of the film 50. The signal from the sensor 94 is input to the controller 9. A first downstream sensor 38 is provided at a position downstream from the slit die 4 for detection of a leading end or a tail end of the coated layer 60*a* applied at the first surface 50*a* of the film. A second downstream sensor 39 is provided at a position downstream from the slit die 4 for detection of a leading end or a tail end of the coated layer 60*b* applied at the second surface 50*b* of the film. The sensors 38 and 39 are connected to the controller 9 for inputting the signals indicating the positions of the leading or trail end of the coated layer 60*a* and 60*b*. These sensors 38, 39 and 94 are constructed as photo cell-type sensozs or electrostatic-type sensors.

Now, an operation of this embodiment will be explained, wherein, to a resin film 50 having a front surface 50*a* to which spaced coated layers 60*a* are already applied, the liquid is applied at the opposite or rear surface 50*b* in such a manner that the coated layers 50*a* and 50*b* at the front and rear surfaces are in a registered condition. A rotating movement from drive motor 90 is applied to the back up roller 2, which causes the film 50 to be moved as shown by an arrow G.

The upstream sensor 94 detects the leading end of an applied layer 60*a* on the front surface of the film at time t0, and a corresponding electric signal is introduced into a controller 9. Then, based on the rotating speed of the electric motor 90 for rotating the back-up roller 2, a calculation on the time t1 is done, which makes the liquid feed pump 7 to commence a rotating movement for allowing the liquid to be fed in such a manner that a point of the commencement of the application of the liquid to the rear surface 50*b* coincides with a leading end of the opposite layer 60*a* of the liquid at the front surface 50*a*. This time t1 is calculated for example by $t1=t0+L/\pi DN+d/\pi DN$, where t0 is the time of the detection of the leading end of the liquid 50*a* by the sensor 94, L is the length of the film 50 from the location of the sensor 94 to the location of the slit die 4, D is a diameter of the backup roller 2, N is the rotating speed of the back-up roller 2 as detected by the sensor 40, and d is a correction amount as described later. A calculation of the time t2 for switching the direction of supply of the fluid pressure to the slit die for commencing the rotating movement o for the slit die 4 to the operation position is done in a similar way to the time t1.

Furthermore, a calculation of time t3 for making the feed pump 7 stop so that a predetermined length of the liquid is applied is performed. The time t3 is calculated for example by $t3=t0+L/\pi DN+1/\pi DN+e/\pi DN$, where 1 is the length of the coated layer and e is a correction amount as described later. A calculation of the time t4 for switching the direction of supply of the fluid pressure to the slid die for commencing the rotating movement of the slit die 4 to the rest position is done in a similar way to the time t3.

When the pump operating timing tl occurs or the number of rotations of the back-up roller 2 corresponding to the pump operating timing is obtained, the controller 9 issues a signal for causing feed pump 7 to be brought into an operation, thereby causing the liquid to be fed to the injection nozzle 13*a* of the slid die 4. Similarly, prior to the start of the operation of the feed pump 7, when the cylinder operating timing t2 comes, the control controller 9 issues a signal which makes the fluid cylinder 17 (FIG. 2) to be fed by a fluid pressure thereby causing the die body 13 to be rotated, from the rest or cleaning position, to the liquid applying position, whereat the liquid nozzle 13*a* is faced with the back-up roller 2, thereby commencing the application of the liquid to the surface of the resin film.

When the time t3 occurs, the feed pump 7 is stopped in order to interrupt of the feed of the liquid 60, and at time t4, the fluid cylinder 17 is operated, which causes the die body 13 to be returned to the rest position. As a result, an application of a length of the liquid on the rear surface 50*b* of the resin sheet 50 is finished.

When the first and second downstream sensors 38 and 39 detect the arrival of the reading ends of the lengths of coated layers 60*a* and 60*b*, respectively, a difference of the times of the detection of the leading end of the applied layer 60*a* by the first sensor 38 and the time of the detection of the leading end of the applied layer 60*b* by the second sensor 39 is calculated. From the calculated time difference, a deviation x is known between the position of the applied layer 60*a* on the front surface 50*a* and position of the applied layer 60*b* on the rear surface 50*b*, of the resin film 50 and is used for calculating the correction amount d used for calculating the time for commencing the operation of the feed pump 7 at the following liquid application from the injection nozzle to the rear surface of the resin film.

Based on the correction of the timing of the commencement of the rotating movement of the feed pump 7, the timing of the operation of the fluid cylinder for obtaining a swing movement of the die body 13 is corrected.

After the correction of the leading end of the applied liquid on the rear surface of the resin film, the feed of the resin sheet 50 is continued, so that the first and second downstream sensors 38 and 39 detect tailing ends of the applied layers on the front and rear surfaces, respectively. The detected signals are introduced into the controller 9, so that a difference in times of detection of the tailing ends between the sensors 38 and 39 is, first, calculated, a deviation between the positions tailing ends of the applied layers is, then, calculated, and a correction amount e for correcting a timing for a stoppage of the feed pump 7 at the following liquid application is calculated based on the deviation.

Based on the correction of the timing of the stoppage of the rotating movement of the feed pump 7, a timing of the operation of the fluid cylinder for obtaining a rotating movement of the die body 13 to the rest position is corrected.

Such a correcting operation is done for an application of the liquid of each of the spaced lengths 60*b* in a consecutive manner.

As a result of the execution of the above correction of the timings of the commencement and an interruption of the application of the liquid onto the rear or second surface 50*b* of the film 50, an aligned condition of the coated layers 60*b* on the rear surface 50*b* with respect to the opposed coated layers 60*a* on the front surface 50*a* can be obtained.

The above embodiment is directed to a application of the layers 60*b* on the rear surface 50*b* of the film 50 in a registered relationship with respect to the layers 60*a* on the front surface 50*a* of the film 50. However, the idea of the present invention can be applied to a case where the opposite coated layers should be spaced at a predetermined offset between the front and rear surfaces of the film . In this case, the timing t1 for the commencement of the application of the liquid is calculated by;

$$t1=t0+L/\pi DN+d/\pi DN+A/\pi DN,$$

where A is the offset amount.

In the above embodiment in FIG. 8, a roller mechanism such as a back-up roller 2 is employed for obtaining a movement of the film 5. However, depending on various factors, such as material or shape of the resin film, any different type of conveyor means, such as a belt conveyor or a cart conveyor can be used.

In the explanation of the embodiment in FIG. 8, the die body 13 is rotated through an angle of 90 degree between the liquid application position and a rest position. However, in place of such an arrangement, an arrangement can be employed where the die body is moved along a straight line between the liquid application position and a rest position, which are located on the straight line.

Furthermore, the liquid feed device 5, which is connected to the slit die 4, may be provided with a means for a heating the tank 6 and or the feed conduit 8, when it is necessary.

Furthermore, in place of the sensor 92 for detecting the rotating speed of the electric motor 90, a sensor may be provided for detecting a peripheral speed of the back-up roller 2.

I claim:

1. An apparatus for applying a liquid coating material layer to a second surface of an object at a predetermined spacing along the length of the object, the object having a first surface which is opposite the second surface, the first surface having an applied coating layer formed at a predetermined spacing along the length of the object, said apparatus comprising:

conveyor means for moving the object along a direction of its length;

a slit die having a nozzle for applying the liquid coating material to the second surface of the object, said nozzle arranged to faced with the second surface of the object;

sensor means arrange at a location upstream from the slit die in the direction of movement of the object for detecting an end of the applied spaced apart layer on the first surface of the object;

means responsive to the detection by the sensor means for executing a liquid applying operation wherein the liquid coating material is applied to the second surface of the object by means of said slit die;

additional sensor means arranged at a location downstream from the slit die for detecting a positional relationship between the applied layers on the first and second surfaces of the object, and;

means, responsive to the relationship detected by said downstream sensor, for correcting the liquid applying operation for applying the liquid coating material to the second surface of the object such that when a newly applied spaced apart layer on the first surface is detected by the upstream sensor the predetermined positional relationship is achieved.

2. An apparatus according to claim 1, wherein said downstream sensor means comprise a first sensor arranged so that it faces the first surface of the object, a second sensor arranged so that it faces the second surface of the object, and means for calculating a difference in time of arrival of the end of the applied spaced apart layer on respectively the first and second surface, whereby the calculated difference is used by the means for correcting the liquid applying operation such that the predetermined positional relationship is achieved.

* * * * *